United States Patent [19]

Dobbins

[11] 4,339,089

[45] Jul. 13, 1982

[54] YARN WINDING APPARATUS AND METHOD

[75] Inventor: Donald J. Dobbins, Waxhaw, N.C.

[73] Assignee: Barmag Barmer Maschinenfabrik AG, Remscheid, Fed. Rep. of Germany

[21] Appl. No.: 209,372

[22] Filed: Nov. 24, 1980

[51] Int. Cl.[3] ..... B65H 54/06; B65H 67/04

[52] U.S. Cl. ..... 242/18 A; 242/25 A; 242/56 A; 242/64

[58] Field of Search ..... 242/18 A, 18 PW, 18 R, 242/18 DD, 25 A, 56 A, 64, 65, 35.5 R, 35.5 A, 35.6

[56] References Cited

U.S. PATENT DOCUMENTS

| | | | |
|---|---|---|---|
| 2,789,774 | 4/1957 | Petersen et al. | 242/18 A |
| 2,837,293 | 6/1958 | Clem | 242/65 |
| 3,075,714 | 1/1963 | Perraut et al. | 242/18 A |
| 3,165,274 | 1/1965 | De Priest | 242/18 A |
| 3,607,566 | 9/1971 | Medney et al. | 242/18 A X |
| 3,913,852 | 10/1975 | Lenk et al. | 242/18 A |
| 3,999,715 | 12/1976 | Schippers et al. | 242/18 A |
| 4,002,307 | 1/1977 | Turk et al. | 242/18 A |

*Primary Examiner*—Stanley N. Gilreath
*Attorney, Agent, or Firm*—Bell, Seltzer, Park & Gibson

[57] ABSTRACT

An apparatus and method for continuously winding a high speed running yarn are provided, and wherein empty bobbins are serially delivered to a winding position and the full bobbins are laterally moved from the winding position to a doffing position. An automatic yarn changeover mechanism is provided for transferring the running yarn from the full bobbin onto an empty bobbin which is brought to the winding position, and such that there is no yarn stoppage or loss of yarn during the changeover procedure. As part of the changeover procedure, the yarn is severed, with the severed end running onto the rotating full bobbin. In order to prevent this severed yarn end from contacting and becoming entangled in the closely adjacent empty bobbin then being wound at the winding position, there is provided air jet means which is operative during the changeover procedure to direct an airstream onto the surface of the rotating full bobbin to restrain the outward radial movement of the severed yarn end, with the airstream continuing until the full bobbin ceases to rotate.

10 Claims, 3 Drawing Figures

YARN WINDING APPARATUS AND METHOD

Figure 1:
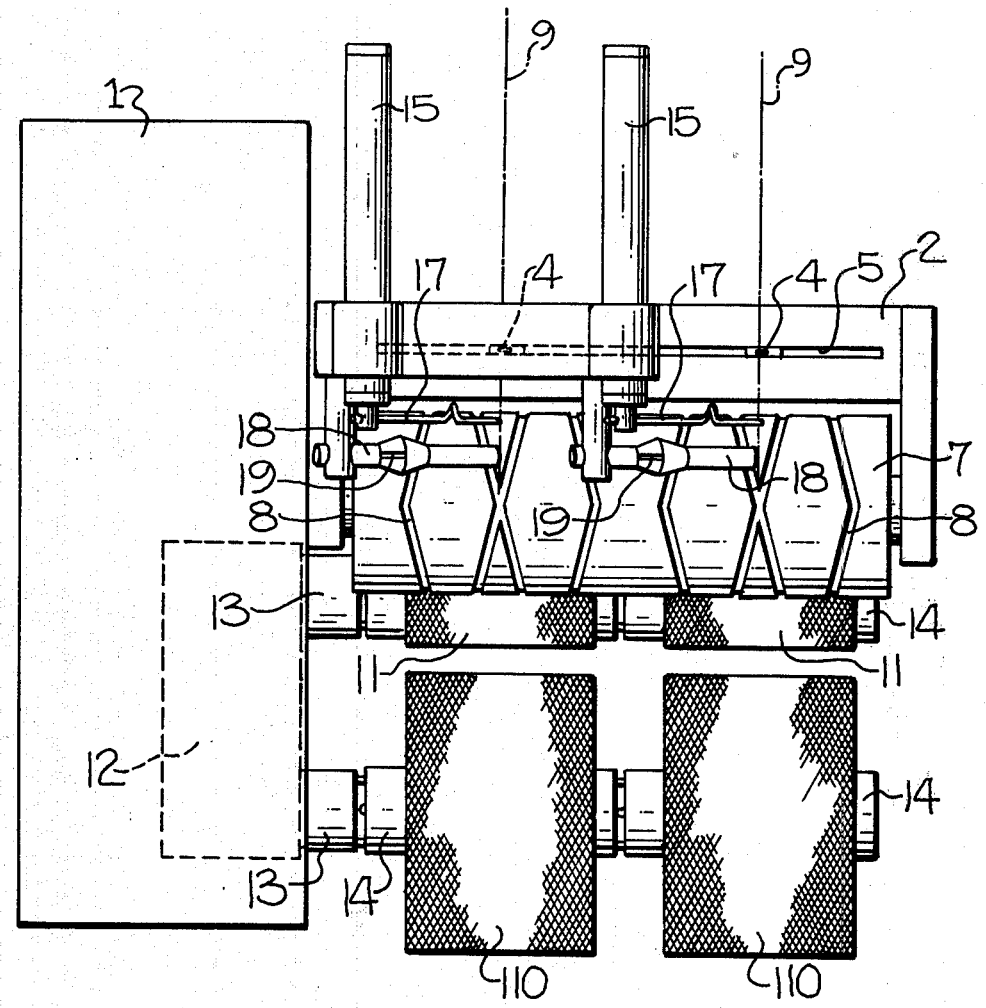

The present invention relates to an improved high speed winding apparatus and method for continuously winding a multifilament thread, yarn or the like onto winding bobbins serially delivered to a winding position, and without yarn stoppage or loss of yarn between bobbin changes.

Yarn winding apparatus of the above general type are disclosed, for example, in U.S. Pat. Nos. 3,913,852, 3,999,715 and 4,002,307. Such winding apparatus typically include a bobbin revolver having at least two rotatably mounted chucks which are adapted to receive empty bobbins thereon, and means for sequentially rotating the bobbin revolver so as to bring an empty bobbin mounted on one chuck to a winding position, while moving a full bobbin mounted on another chuck from the winding position to a doffing position. In the winding position, the bobbin is preferably driven at its circumference by a friction drive roller.

After a fixed winding time, or after a bobbin with a predetermined diameter has been produced, the running yarn or thread is transferred by means of an automatic yarn changeover mechanism to the rotating empty bobbin which has been delivered to the winding position. More particularly, the yarn is removed from the reciprocating thread traverse guide and caught by an auxiliary thread guide positioned at the end of the traverse stroke adjacent the machine frame, which then draws the yarn into the shape of a loop. The yarn segment of the yarn loop running to the auxiliary thread guide is brought into contact with the empty bobbin, where it is caught by a thread catching device, e.g., a slot or a notch, and wound onto the bobbin. At the same time, the yarn segment of the loop running to the fully wound bobbin is severed, and the severed end is wound onto it.

After the yarn is severed, the bobbin revolver is turned through various intermediate positions to bring the full bobbin into the bobbin doffing position. During this procedure, the full bobbin continues to rotate for a period of time before it fully stops, and there is a danger that the free severed end of the yarn may fly radially outwardly and come into contact with the empty bobbin and become entangled thereon. This danger is amplified by the fact that the diameter of the new bobbin being produced at the winding position builds relatively quickly, and the distance between the surfaces of the two bobbins rapidly becomes smaller and smaller.

Significant operating difficulties can result from the severed yarn end of the fully wound bobbin coming into contact with the new bobbin, and where it becomes entangled or overwound on it, since the winding operation must then be interrupted, which results in a substantial production loss at today's high winding speeds. In addition, the bobbin in the winding position probably cannot be further used by reason of the overwound thread thereon.

It is accordingly an object of the present invention to provide a yarn winding apparatus and method having an automatic yarn changeover mechanism, and wherein the above problems of the present apparatus are effectively avoided.

It is a more specific object of the present invention to provide a yarn winding apparatus having an automatic yarn changeover mechanism of the described type, and wherein the severed yarn end is effectively precluded from coming into contact with the empty bobbin which is brought to the winding position.

These and other objects and advantages are achieved in the embodiment of the invention described herein by the provision of a yarn winding apparatus having an automatic yarn changeover mechanism which includes air jet means for restraining the outward radial movement of the severed yarn end which extends from the rotating full bobbin, so as to prevent such yarn end from contacting and becoming entangled with the empty bobbin which has been brought to the winding position. Upon the full bobbin reaching the doffing position and ceasing to rotate, the yarn end may then by physically fixed to the surface of the bobbin, either automatically or manually by the operator, and the full bobbin removed from its supporting chuck.

In the specific illustrated embodiment of the invention, the air jet means comprises a blowing nozzle positioned to direct an oblique airstream onto the circumference of the fully wound bobbin, and such that the airstream moves generally tangentially along a portion of the periphery of the yarn package. Further, the area of the circumference where the yarn end is likely to come into contact with the adjacent empty bobbin in the winding position, which as noted above is particularly endangered, is covered by the airstream, so that the yarn end remains held against the circumference of the fully wound bobbin. To this end, the blowing nozzle is positioned on the frame of the winding apparatus at such a height that the airstream hits the full bobbin above its longitudinal center line, when the bobbin revolver is turned so as to lower the full bobbin from the winding position into the bobbin doffing position. Also, the direction of the airstream is opposite to the direction of rotation of the full bobbin, as well as the direction of rotation of the bobbin revolver.

One or more blowing nozzles for producing an oblique airstream, or a narrow air curtain, are preferably positioned along a mounting rod extending parallel to the chucks of the bobbin revolver, and outside the arc of movement of the bobbin revolver and the fully wound bobbin. After the yarn has been transferred, these nozzles are supplied with pressurized air, at least within the period of time needed for turning the bobbin revolver to bring the full bobbin from the winding position into the bobbin doffing position, and for the slowing down and stopping of the full bobbin. In this critical phase, the loose yarn end is thereby held within the air curtain partly covering the full bobbin, and it is prevented from coming into contact with the empty bobbin which is moved to the winding position.

Figure 2:
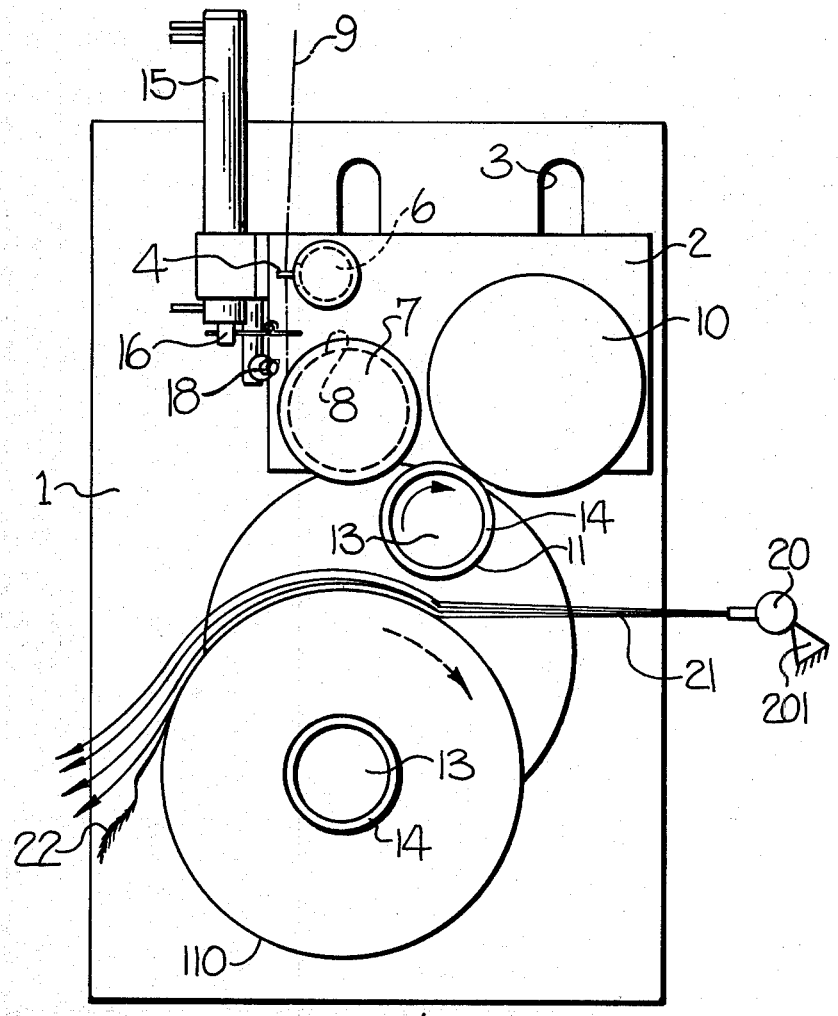
Figure 3:
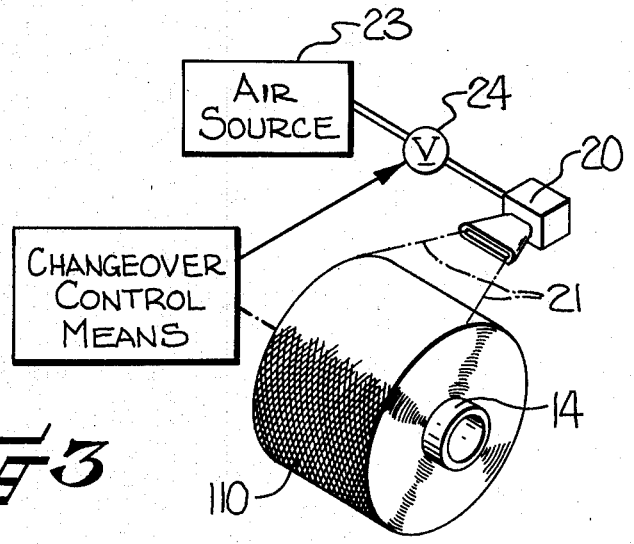

Some of the objects and advantages of the invention having been stated, others will appear as the description proceeds, when taken in connection with the accompanying drawings, in which FIG. 1 is a side elevation view of one embodiment of a winding apparatus embodying the features of the present invention;

FIG. 2 is a partly schematic, front elevation view of the winding apparatus and illustrating the yarn path of travel to the empty bobbin after the yarn transfer from the full bobbin, and FIG. 3 is a partly schematic perspective view of the full bobbin, and illustrating one preferred configuration of the airstream.

The specific features of the winding apparatus represented in the present drawings are similar to the apparatus described in the U.S. Pat. No. 3,999,715, and the means for transferring the yarn from the full bobbin to the empty bobbin corresponds to the mechanism which is described in the U.S. Pat. No. 4,002,307. Reference to these prior patents may accordingly be made for a more specific description of these known components of the present invention.

The illustrated winding apparatus includes the casing 1 which is mounted on the frame of a multiposition winding machine. A vertically movable head 2 projects laterally from the casing 1, and the head 2 is guided in its vertical movement in vertical guides 3. For each bobbin to be wound, the head 2 has a reciprocating thread traverse guide 4, which moves to and fro in a slot 5 and is driven by a cross spiralled roller 6. The thread traverse guide is followed by a rotating thread guide in the form of a traverse roller 7 which has on its surface an endless thread guide groove 8 for additionally traversing the thread 9. The head 2 further includes the friction drive roller 10, which is in circumferential contact with the bobbin 11 which is being wound. The friction drive roller 10 is driven by a synchronous motor (not shown). Further details relating to the coordination of the drives for the cross spiralled roller 6, the traverse roller 7 and the friction drive roller 10, are described in the cited U.S. Pat. No. 3,999,715.

In the casing 1 of the head, there is a bobbin revolver 12 with two horizontal, rotatably mounted bobbin chucks 13, each for clampingly mounting at least one bobbin tube 14. The chucks 13 are diametrically opposed and located adjacent the circumference of the bobbin revolver 12. In the embodiment according to FIG. 1, two bobbin tubes 14 can be coaxially slipped onto each chuck 13, and accordingly, there are two like yarn feeding and changeover mechanisms.

The yarn changeover mechanisms for the transfer of the running threads 9 from a fully wound bobbin 110 to an empty tube 14 are not specifically material to for the present invention, but they will be generally described for the sake of completeness. Each yarn changeover mechanism includes the cylinder piston unit 15 carrying an auxiliary thread guide 17 on the end of a piston rod, which is guided along a curved slot track. Further, each mechanism includes a horizontal mandrel 18 which is diagonally angled toward the yarn traverse plane. The mandrel 18 serves to form a yarn loop, and includes a mechanism 19 for providing the yarn reserve during the yarn transfer. Further information regarding the changeover mechanism may be found in the detailed description of U.S. Pat. No. 4,002,307.

In accordance with the present invention, at least one blowing nozzle 20 is pivotably mounted on a mounting rod 201 located laterally spaced from the bobbin revolver 12, as well as the arc of movement of the completed bobbin 110 during the rotation of the bobbin revolver. Thus the ejected oblique airstream 21 hits the surface of the completed bobbin 110 in a generally tangential direction above its longitudinal center plane. Preferably, the oblique airstream 21 leaving the blowing nozzle 20 extends over the full width of the completed bobbin 110 and forms an air curtain (note FIG. 3), by which the free yarn end 22 rotating with the completed bobbin 110 is held closely adjacent the circumference of the rotating full bobbin. Also, the airstream is directed between the full bobbin and the empty bobbin then being wound. Further, the blowing nozzle or nozzles should be positioned to direct the airstream opposite to the direction of rotation of the bobbins. As a result, the airstream impinges upon the severed free yarn end and restrains its outward radial movement, and thus the free yarn end is not able to contact and disturb the operation of the new bobbin while it builds in size by becoming entangled in the winding being built up, or by being overwound thereon.

The blowing nozzles 20 are mounted on the machine frame along a mounting rod 201, and are connected to an air source 23 (FIG. 3) which serves to supply pressurized air to the winding machine. A solenoid valve 24 or the like is positioned in the supply line to each winding station, which is opened and closed in dependence on the control of the rotation of the bobbin revolver 12, in order to minimize the consumption of air. In this regard, it is preferable that the blowing nozzles 20 be supplied with pressurized air concurrently upon the completed bobbin 110 being withdrawn from the friction drive roller 10, and that the supply of pressurized air to the blowing nozzles 20 be terminated after the bobbin revolver 12 has moved the full bobbin to the doffing position and concurrently upon the full bobbin ceasing to rotate. Alternatively, the airstream may continue until the full bobbin 110 has been replaced by a new empty tube 14.

In the drawings and specification, there has been set forth a preferred embodiment of the invention and although specific terms are employed, they are used in a generic and descriptive sense only and not for purposes of limitation.

That which is claimed is:

1. An apparatus for continuously winding a high speed running yarn onto bobbins serially delivered to a winding position and without yarn stoppage or loss of yarn between bobbin changes, and comprising a bobbin revolver mounting at least one bobbin receiving chucks, means for sequentially rotating the bobbin revolver so as to bring an empty bobbin mounted one chuck to a winding position while moving a full bobbin mounted on another chuck from the winding position to a doffing position, means for traversing the yarn in a traverse plane across the bobbin which is in the winding position, means for rotatably driving the bobbin in the winding position, and yarn changeover means for transferring the running yarn being wound on a full bobbin to a position wherein the yarn may be caught by an empty bobbin which is moved to the winding position and so as to sever the yarn and commence winding the running yarn onto the empty bobbin, the improvement wherein said yarn changeover means includes air jet means for restraining the outward radial movement of the severed yarn end which extends from the rotating full bobbin, so as to prevent the same from contacting and becoming entangled with the empty bobbin then being wound at the winding position.

2. The apparatus as defined in claim 1 wherein said air jet means includes nozzle means for directing an airstream onto the circumference of the full bobbin in a generally tangential direction which is opposite to the direction of rotation of such bobbin.

3. The apparatus as defined in claim 2 wherein said nozzle means is positioned so as to direct the airstream between the full bobbin and the empty bobbin then being wound.

4. The apparatus as defined in claim 3 wherein said nozzle means includes means for directing the airstream along substantially the full width of the full bobbin.

5. The apparatus as defined in any one of claims 1–4 wherein said yarn changeover means further includes control means for actuating the air jet means substantially upon commencement of the yarn changeover procedure, and terminating the air jet means substantially upon the full bobbin reaching the doffing position and ceasing to rotate.

6. A method for continuously winding a high speed running yarn onto bobbins serially presented to a winding position, and without yarn stoppage or loss of yarn between bobbin changes, and comprising the steps of rotating a first bobbin positioned at the winding position while winding the yarn thereupon, laterally withdrawing the rotating first bobbin from the winding position upon such bobbin becoming full, while moving an empty second bobbin to the winding position and operatively rotating the second bobbin, transferring the running yarn onto the rotating second bobbin at the winding position, and including severing the running yarn, and directing an airstream to impinge upon the severed yarn end which extends from the rotating full bobbin and thereby restrain the outward radial movement thereof, and continuing the airstream until the full bobbin substantially ceases to rotate, whereby the severed yarn end extending from the rotating full bobbin is prevented from contacting and becoming entangled with the empty second bobbin then being wound at the winding position.

7. The method as defined in claim 6 wherein the airstream is directed onto the circumference of the rotating full bobbin and in a generally tangential direction which is opposite to its rotational direction.

8. The method as defined in claim 7 wherein the airstream extends across substantially the full width of the rotating full bobbin.

9. The method as defined in any one of claims 6, 7 or 8 wherein the airstream is directed between the rotating full bobbin and the empty second bobbin being wound at the winding position.

10. The method as defined in claim 9 wherein the step of directing an airstream is commenced substantially concurrently with the first bobbin being laterally withdrawn from the winding position, and is terminated substantially concurrently with the first bobbin ceasing to rotate.

* * * * *

UNITED STATES PATENT AND TRADEMARK OFFICE

CERTIFICATE OF CORRECTION

PATENT NO. : 4,339,089

DATED : July 13, 1982

INVENTOR(S) : Donald J. Dobbins

It is certified that error appears in the above-identified patent and that said Letters Patent are hereby corrected as shown below:

Column 4, line 34, "one" should be --two--.
Column 4, line 36, after "mounted" insert --on--.

Signed and Sealed this

*Fourteenth* Day of *September 1982*

[SEAL]

*Attest:*

GERALD J. MOSSINGHOFF

*Attesting Officer*

*Commissioner of Patents and Trademarks*